US011828428B1

(12) United States Patent
Chang

(10) Patent No.: US 11,828,428 B1
(45) Date of Patent: Nov. 28, 2023

(54) VEHICLE LAMP STRUCTURE

(71) Applicant: SONAR AUTO PARTS CO., LTD., New Taipei (TW)

(72) Inventor: Chung-Yi Chang, Hsinchu County (TW)

(73) Assignee: SONAR AUTO PARTS CO., LTD., New Taipei (TW)

( * ) Notice: Subject to any disclaimer, the term of this patent is extended or adjusted under 35 U.S.C. 154(b) by 0 days.

(21) Appl. No.: 18/161,849

(22) Filed: Jan. 30, 2023

(51) Int. Cl.

| | |
|---|---|
| ***F21S 41/148*** | (2018.01) |
| ***F21S 41/32*** | (2018.01) |
| ***F21S 41/275*** | (2018.01) |
| ***F21S 45/47*** | (2018.01) |

(Continued)

(52) U.S. Cl.
CPC ..... *F21S 41/148* (2018.01); *F21S 41/275* (2018.01); *F21S 41/321* (2018.01); *F21S 45/47* (2018.01); *F21S 45/49* (2018.01); *F21W 2107/10* (2018.01)

(58) Field of Classification Search
CPC ..... F21S 45/47; F21S 45/49; F21S 41/148; F21S 41/33; F21S 41/36; F21S 41/25; F21S 43/14; F21S 41/141; F21S 41/143; F21W 2107/10; F21W 2102/13; F21W 2102/135; F21W 2102/155; F21W 2102/30; F21V 29/70; F21V 7/00; F21V 5/008; F21V 19/001; G02B 19/0028; G02B 27/0955; G02B 19/0066; G09F 9/33; F21K 9/00; F21Y 2115/10; F21Y 2103/10; F21Y 2113/13; B60Q 2900/10; B60Q 2300/42; B60Q 2300/114; B60Q 11/005; B60Q 1/52; B60Q 1/2615; B60Q 1/26; B60Q 1/24; B60Q 1/143
See application file for complete search history.

(56) References Cited

U.S. PATENT DOCUMENTS

| | | | | |
|---|---|---|---|---|
| 7,237,936 | B1 * | 7/2007 | Gibson | F21S 45/33 362/547 |
| 2014/0126214 | A1 * | 5/2014 | Gebhard | F21V 29/74 362/294 |

(Continued)

FOREIGN PATENT DOCUMENTS

| | | | |
|---|---|---|---|
| CN | 106813186 | A | 6/2017 |
| CN | 108954205 | A | 12/2018 |

(Continued)

*Primary Examiner* — Omar Rojas Cadima
(74) *Attorney, Agent, or Firm* — Li & Cai Intellectual Property Office

(57) ABSTRACT

A vehicle lamp structure includes a heat dissipating device, an LED light source, a reflector, a supporting frame, a light-blocking plate, and a lens unit. The LED light source, the reflector, and the supporting frame are disposed on the heat dissipating device. The LED light source includes a substrate and LED units that are arranged along a lengthwise direction. The reflector has reflection surfaces that are respectively located above the LED units such that light emitted by the LED units is reflected by the reflection surfaces. The light-blocking plate is disposed in the supporting frame and has a frame body and at least one baffle, and the baffle is disposed in the frame body, such that through holes are formed in the frame body so that the light reflected by the plurality of reflection surfaces can pass through the through holes, respectively.

15 Claims, 11 Drawing Sheets

(51) Int. Cl.
*F21S 45/49* (2018.01)
*F21W 107/10* (2018.01)

(56) References Cited

U.S. PATENT DOCUMENTS

| | | | |
|---|---|---|---|
| 2016/0082881 | A1 | 3/2016 | Yamato et al. |
| 2020/0335660 | A1 | 10/2020 | Kang et al. |

FOREIGN PATENT DOCUMENTS

| | | | |
|---|---|---|---|
| CN | 110043864 | A | 7/2019 |
| TW | M639399 | U | 4/2023 |

* cited by examiner

VEHICLE LAMP STRUCTURE

FIELD OF THE DISCLOSURE

The present disclosure relates to a vehicle lamp structure, and more particularly to a vehicle lamp structure that mounts on a vehicle.

BACKGROUND OF THE DISCLOSURE

Vehicle headlights are crucial in the use of vehicles, and the main function of the vehicle headlights is to provide the function of illuminating the front of the vehicle for the driver, especially when the vehicle is running in environments with poor lighting. However, vehicle headlights that have excessive brightness can cause a vision of oncoming drivers moving in an opposite direction to be impeded by glare, such that traffic accidents may occur. When driving in environments that have poor lighting, in order to ensure that the vehicle headlights are sufficient to illuminate the front of the vehicle and can protect the vision of the oncoming drivers moving in the opposite direction from glare, the vehicle headlights are required to comply with light shape regulations. However, most of the existing vehicle headlights can only meet basic requirements of the light shape regulations, so that the safety and use rate of light are difficult to be further improved.

SUMMARY OF THE DISCLOSURE

In response to the above-referenced technical inadequacies, the present disclosure provides a vehicle lamp structure for providing an expected lighting effect and improving the safety and use rate of light.

In one aspect, the present disclosure provides a vehicle lamp structure. The vehicle lamp structure includes a heat dissipating device, an LED light source, a reflector, a supporting frame, a light-blocking plate, and a lens unit. The LED light source is disposed on the heat dissipating device. The LED light source includes a substrate and a plurality of LED units that are disposed on the substrate and arranged along a lengthwise direction. The reflector is disposed on the heat dissipating device. The reflector has a plurality of reflection surfaces that are respectively located above the LED units such that light emitted by the LED units is reflected by the plurality of reflection surfaces. The supporting frame is disposed on the heat dissipating device and has a hollow body. The light-blocking plate is disposed in the supporting frame. The light-blocking plate has a frame body and at least one baffle, and the baffle is disposed in the frame body so that a plurality of through holes are formed in the frame body. The plurality of through holes are spaced apart from each other such that the light reflected by the plurality of reflection surfaces are able to pass through the plurality of through holes, respectively. The lens unit is located at a front end of the supporting frame. The lens unit has a lens body that has at least one convex surface and at least one concave surface formed at a rear end of the lens body, the at least one convex surface and the at least one concave surface are arced surfaces, and the at least one convex surface and the at least one concave surface respectively correspond in position to the reflection surfaces. The light emitted by the LED units is able to be reflected by the plurality of reflection surfaces before being emitted outward through the light-blocking plate and the lens unit.

Therefore, in the vehicle lamp structure provided by the present disclosure, the vehicle lamp structure includes a heat dissipating device, an LED light source, a reflector, a supporting frame, a light-blocking plate, and a lens unit. The LED light source, the reflector, and the supporting frame are disposed on the heat dissipating device. The LED light source includes a substrate and a plurality of LED units that are arranged along a lengthwise direction. The reflector has a plurality of reflection surfaces that are respectively located above the LED units such that light emitted by the LED units is reflected by the plurality of reflection surfaces. The light-blocking plate is disposed in the supporting frame and has a frame body and at least one baffle, and the baffle is disposed in the frame body, such that through holes are formed in the frame body so that the light reflected by the plurality of reflection surfaces can pass through the through holes, respectively. In this way, light diffraction or interference can be avoided. The lens unit is located at a front end of the supporting frame. The lens unit has a lens body that has at least one convex surface and at least one concave surface formed at a rear end of the lens body, the at least one convex surface and the at least one concave surface are arced surfaces, and the at least one convex surface and the at least one concave surface respectively correspond in position to the reflection surfaces. The convex surface and the concave surface respectively have effects of light dispersion and light convergence so as to control a refraction of the light, such that the light can be projected as anticipated. Therefore, an expected lighting effect can be provided, and the safety and use rate of light can be improved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
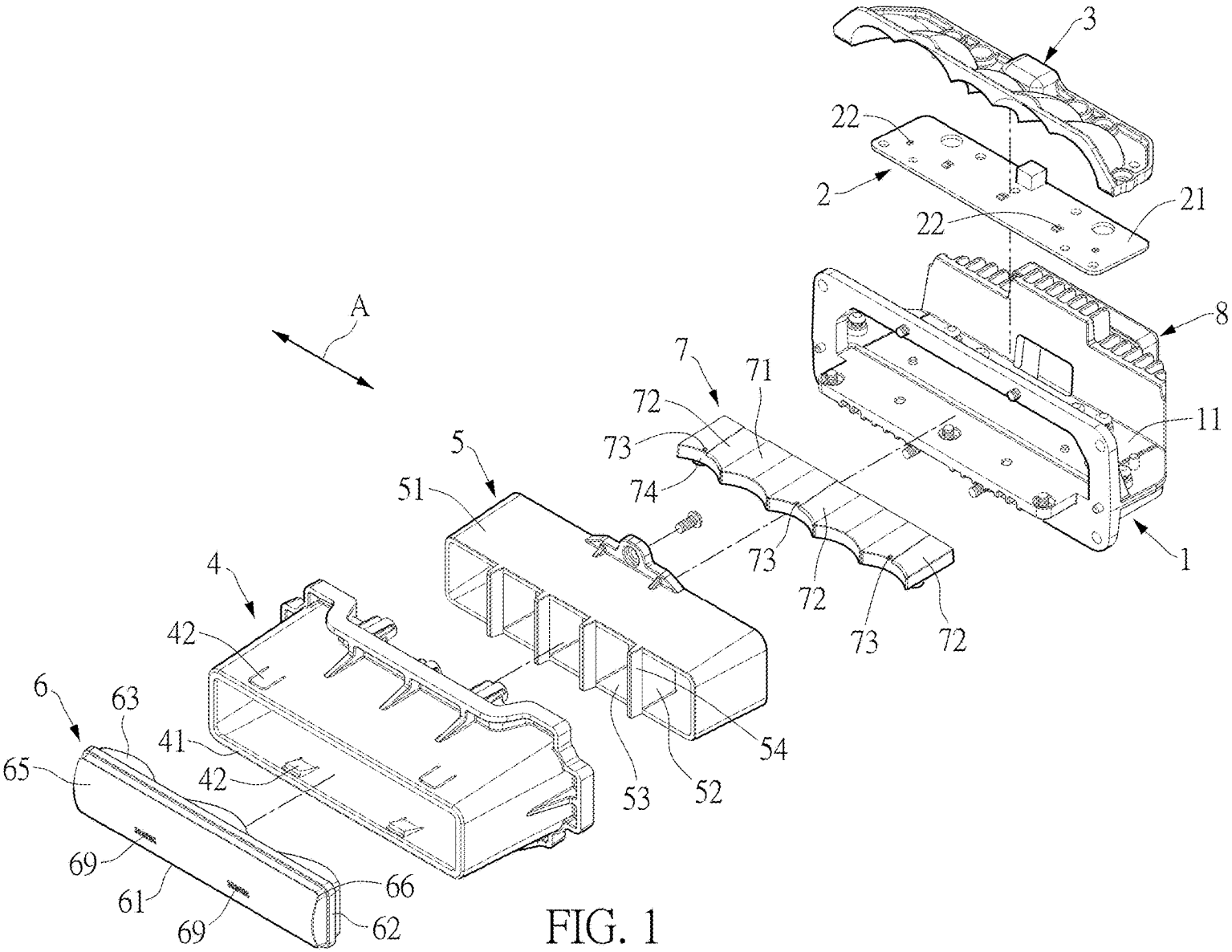
FIG. 1 is a schematic exploded perspective view of a vehicle lamp structure of the present disclosure.
Figure 2:
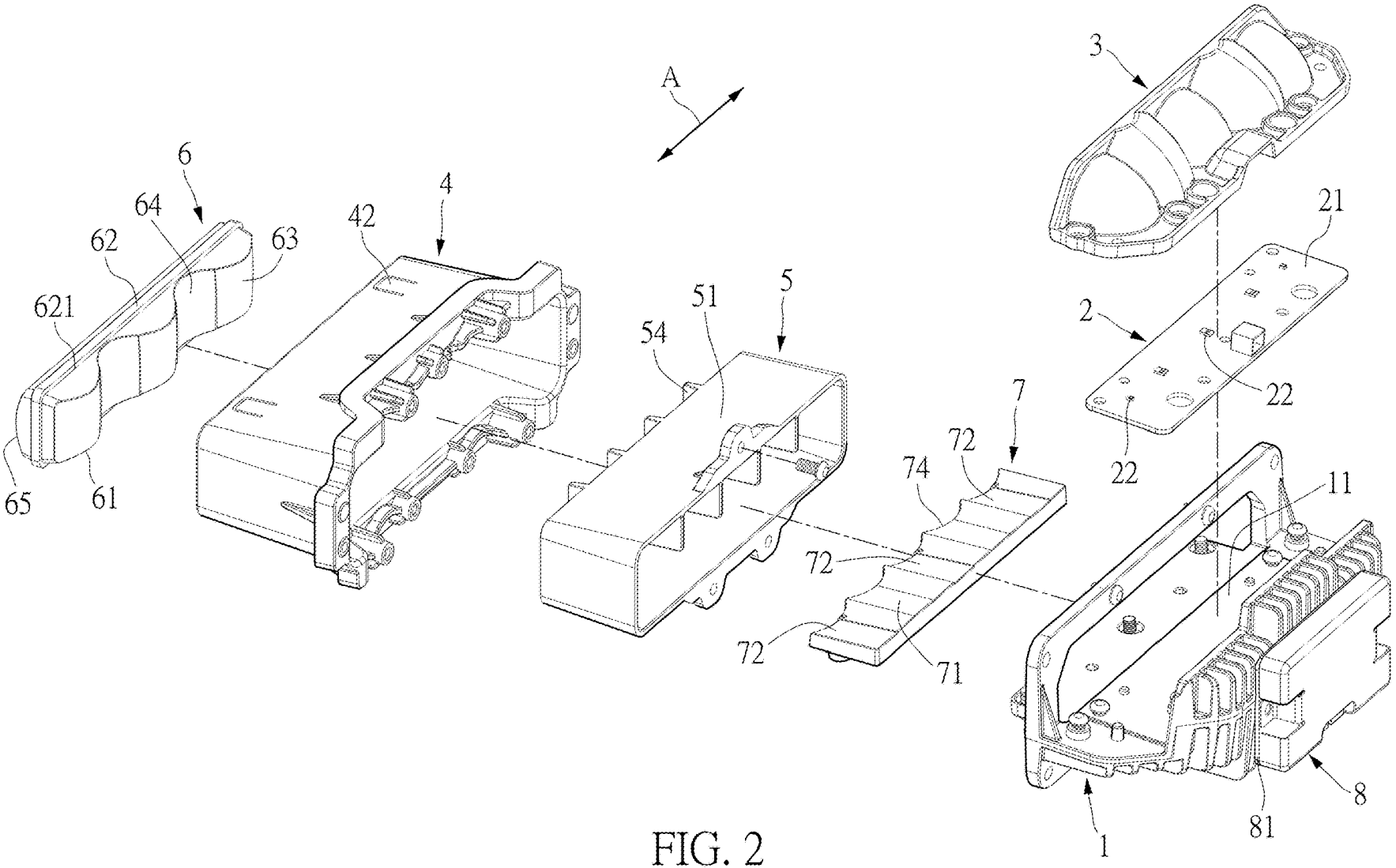
FIG. 2 is another schematic exploded perspective view of the vehicle lamp of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

EMBODIMENT

Referring to FIG. 1 to FIG. 4, one embodiment of the present disclosure provides a vehicle lamp structure that can be mounted on vehicles such as automobiles or motorbikes to provide a vehicle headlight function. The vehicle lamp structure includes a heat dissipating device 1, an LED light source 2, a reflector 3, a supporting frame 4, a light-blocking plate 5, and a lens unit 6. The vehicle lamp structure can further include a light-shielding plate 7.

The heat dissipating device 1 is made of a metal material that has good heat conductivity (e.g., copper or aluminum), and a structure of the heat dissipating device 1 is not limited in the present disclosure. The LED light source 2 is disposed on the heat dissipating device 1. In the present disclosure, the heat dissipating device 1 has a carrying surface 11, and the LED light source 2 is disposed on the carrying surface 11. The LED light source 2 can upwardly emit light, and heat generated by the LED light source 2 can be transmitted to the heat dissipating device 1 so that the heat dissipating device 1 can assist in heat dissipation.

A driving device 8 can be disposed at a rear end or a bottom portion of the heat dissipating device 1. The driving device 8 is electrically connected to the LED light source 2, and the driving device 8 has driving circuits disposed therein, so that the driving device 8 can be used to drive the LED light source 2 such that the LED light source 2 emits light. The driving device 8 can have an aluminum plate 81 that is in contact with the heat dissipating device 1, so that a heat of the driving device 8 can be transmitted to the heat dissipating device 1 and the heat dissipating device 1 can be used to assist in dissipating the heat of the driving device 8. The driving device 8 can also be designed to be an external device.

Figure 9:
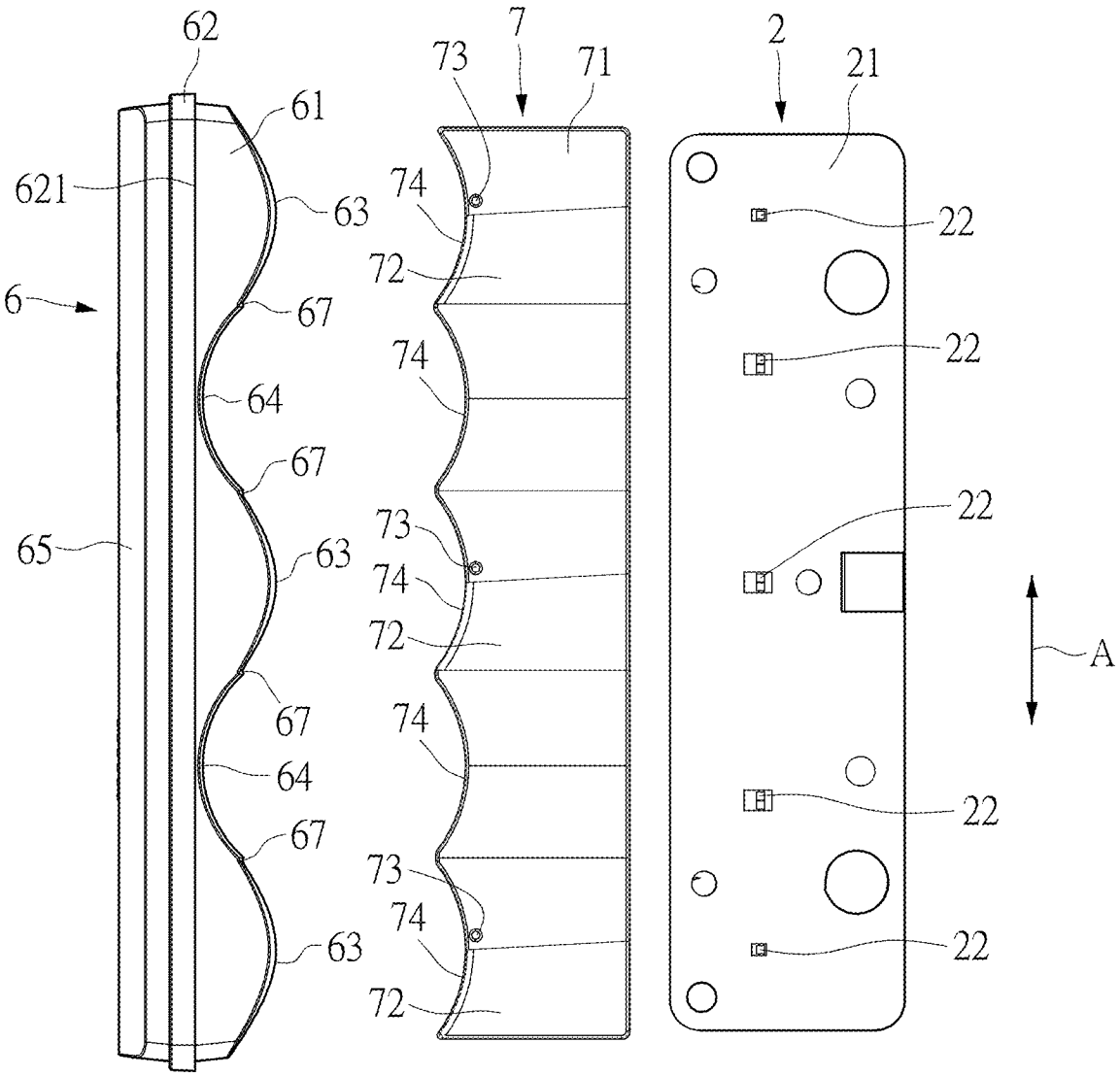
FIG. 9 is a schematic top view of an LED light source, a light-shielding plate, and the lens unit of the present disclosure.

The LED light source 2 includes a substrate 21 and a plurality of LED units 22 (as shown in FIG. 9), and a quantity of the LED units 22 is not limited in the present disclosure. The quantity of the LED units can be two, three, four, five, six, or seven. The LED units 22 are disposed on the substrate 21 and are electrically connected to the substrate 21. The LED units 22 are arranged along a lengthwise direction A (a left-right direction), and preferably, the LED units 22 can be arranged in a single row. That is, the LED units 22 can be in a linear arrangement or substantially in a linear arrangement.

Figure 5:
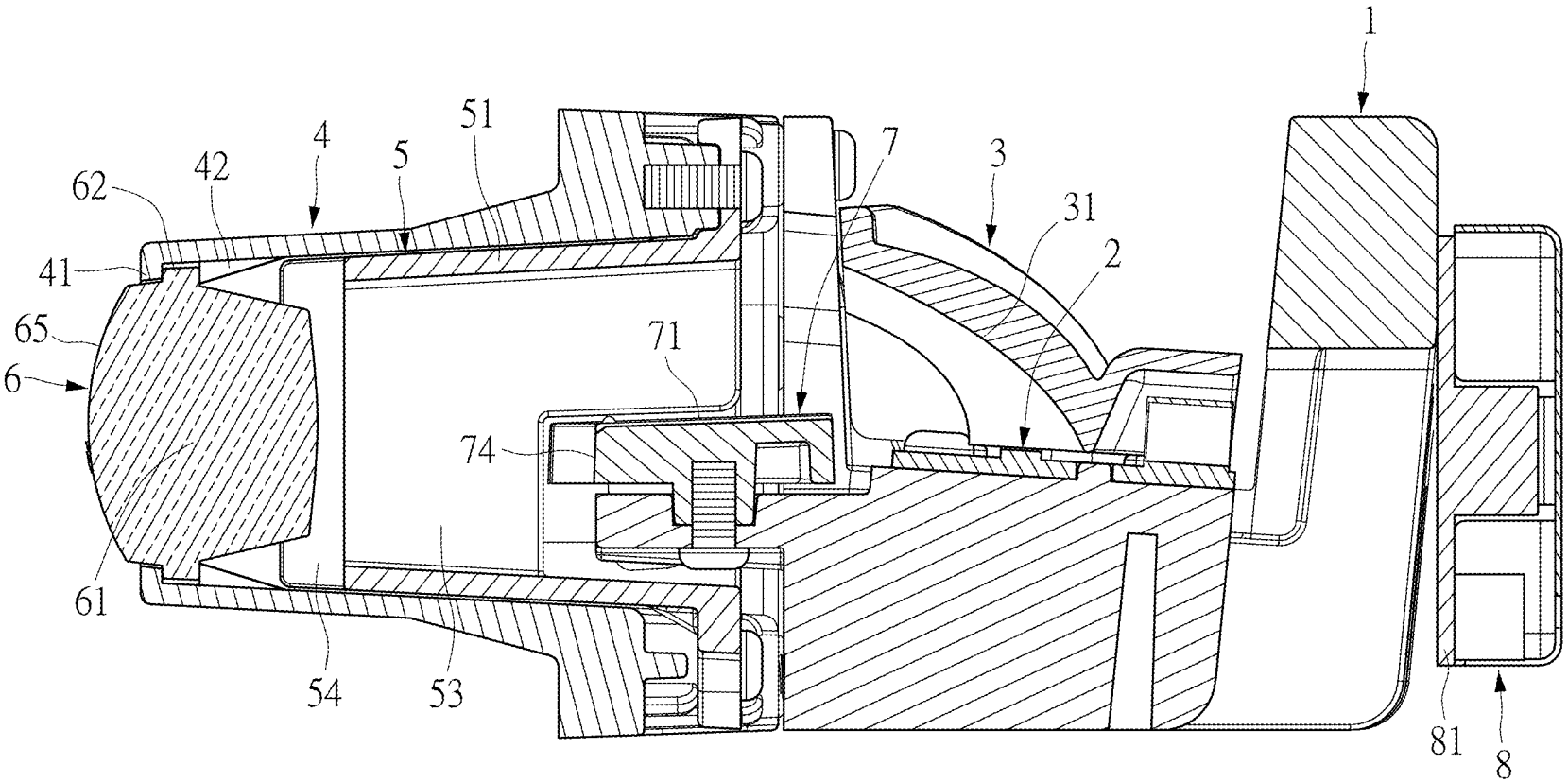
FIG. 5 is a cross-sectional view taken along line V-V of FIG. 3.
Figure 6:
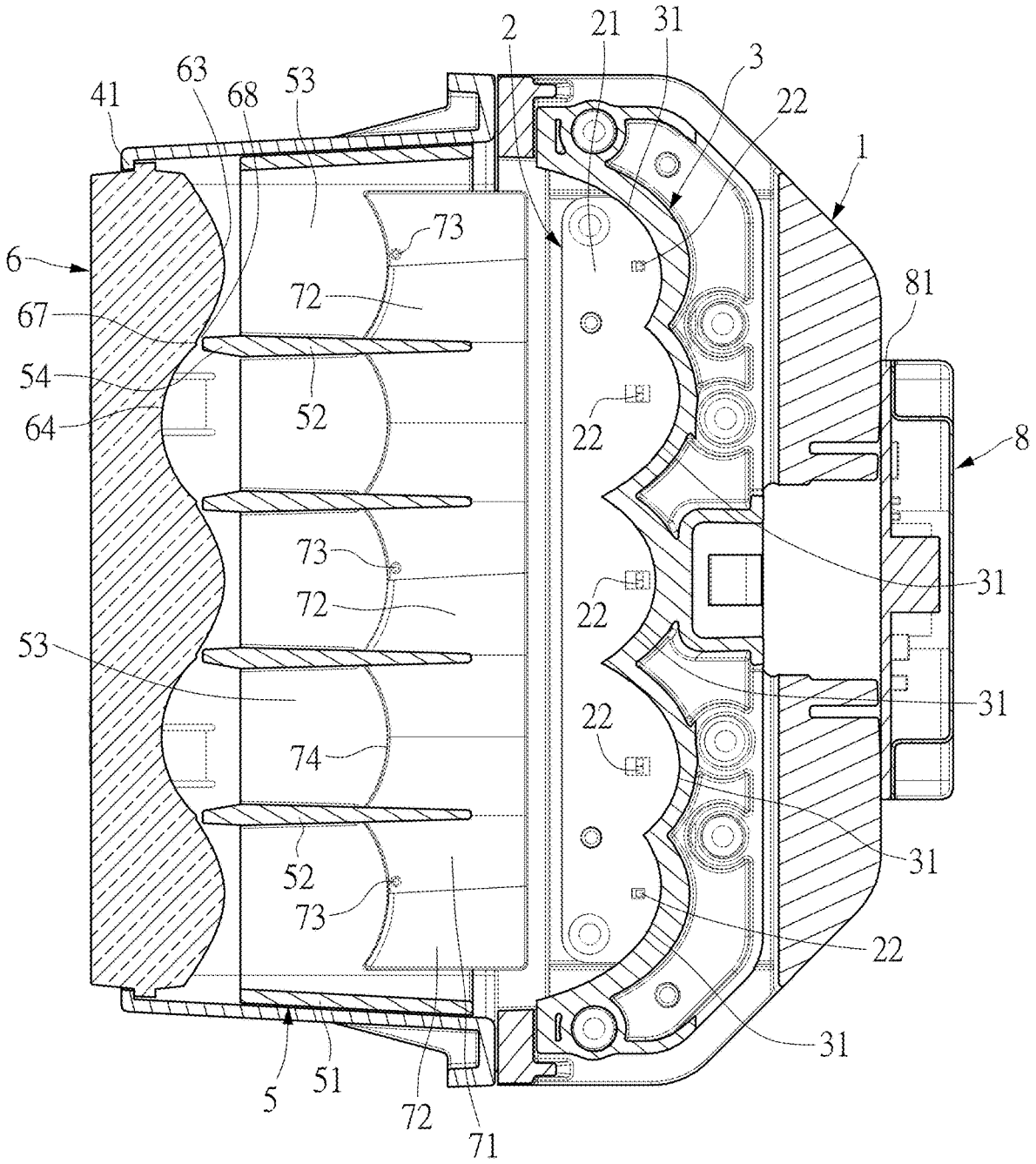
FIG. 6 is a cross-sectional view taken along line VI-VI of FIG. 3.

The reflector 3 is disposed on the heat dissipating device 1, and the reflector 3 is located above the LED light source 2. The reflector has a plurality of reflection surfaces 31 (as shown in FIG. 5 and FIG. 6), the reflection surfaces 31 are located at an inner side of the reflector 3, and the reflection surfaces 31 are respectively located above the LED units 22, such that light emitted by the LED units 22 is reflected by the plurality of reflection surfaces 31 and emitted outward through the light-blocking plate 5 and the lens unit 6.

The supporting frame 4 is disposed on the heat dissipating device 1, and the supporting frame 4 can be disposed at a front end of the heat dissipating device 1. The "front end" of the heat dissipating device 1 and other components of the present disclosure indicate one end of the components that faces in the light emitting direction of the vehicle lamp structure, and a "rear end" indicates one end of the components that faces away from the light emitting direction of the vehicle lamp structure. The supporting frame 4 can threadedly fixed onto the heat dissipating device 1 by using screws. The supporting frame 4 has a hollow body, and two ends (a front end and a rear end) of the supporting frame 4 are each an opening.

The light-blocking plate 5 is disposed in the supporting frame 4, and the light-blocking plate 5 has a frame body 51 and at least one baffle 52. The frame body 51 is a hollow body, and two ends (a front end and a rear end) of the light-blocking plate 5 are each an opening. In this embodiment, the light-blocking plate 5 has multiple baffles 52 that are arranged to be upright, and the baffles 52 are disposed in the frame body 51 and spaced apart from each other so that a plurality of through holes 53 spaced apart from each other are formed in the frame body 51. Therefore, the light emitted from the LED units 22 can pass through the plurality of through holes 53, and light diffraction or light interference can be avoided. Preferably, a front end of each of the baffles 52 has a protruding portion 54 extending therefrom, and the protruding portion 54 protrudes from a front end of the frame body 51, so as to improve a light-blocking effect. Preferably, one side of the protruding portion 54 that is adjacent to a concave surface 64 has an oblique surface (as shown in FIG. 6), so that the light can be more efficiently projected to the lens unit 6.

Figure 7:
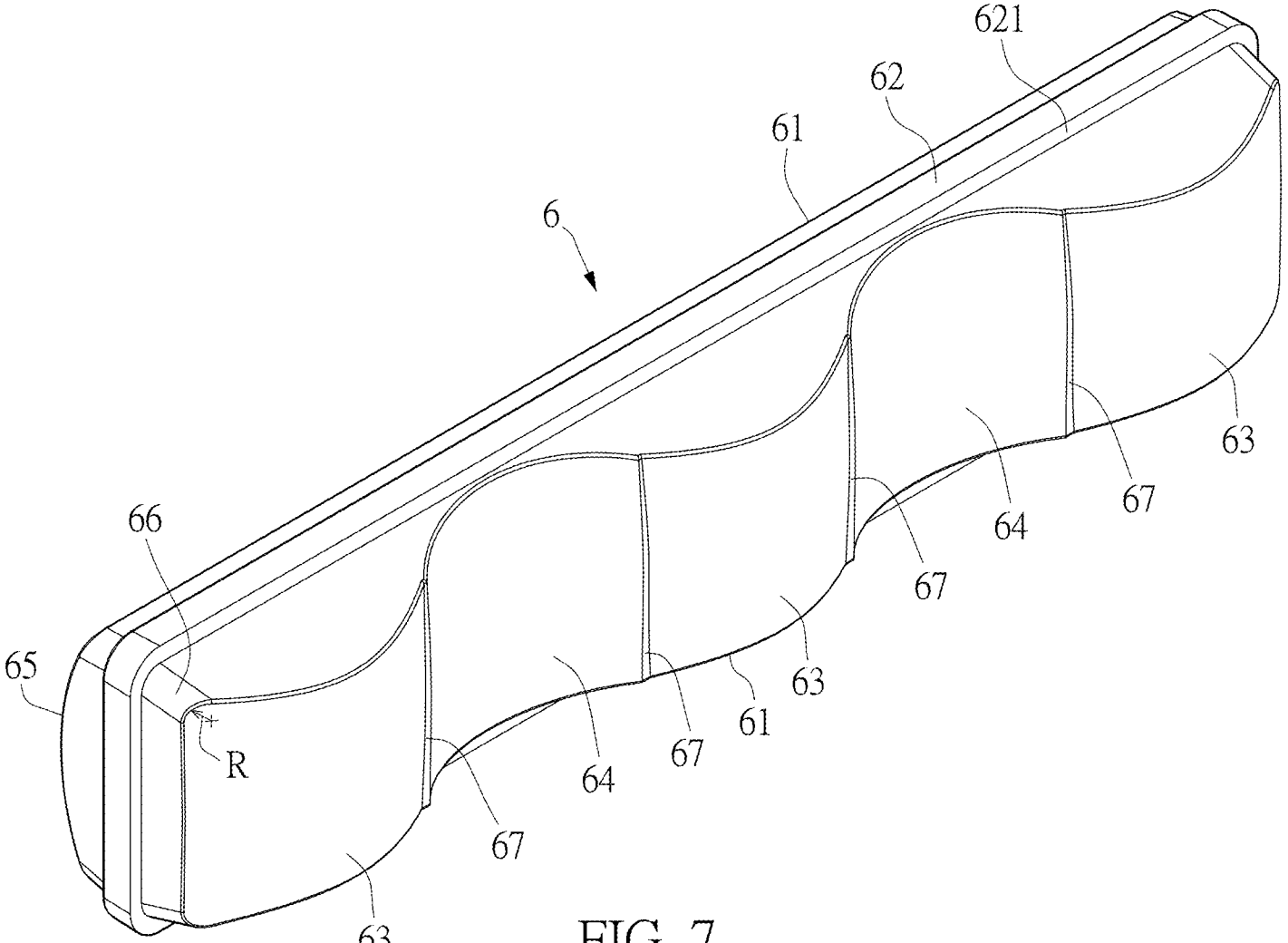
FIG. 7 is a schematic perspective view of a lens unit of the present disclosure.
Figure 8:
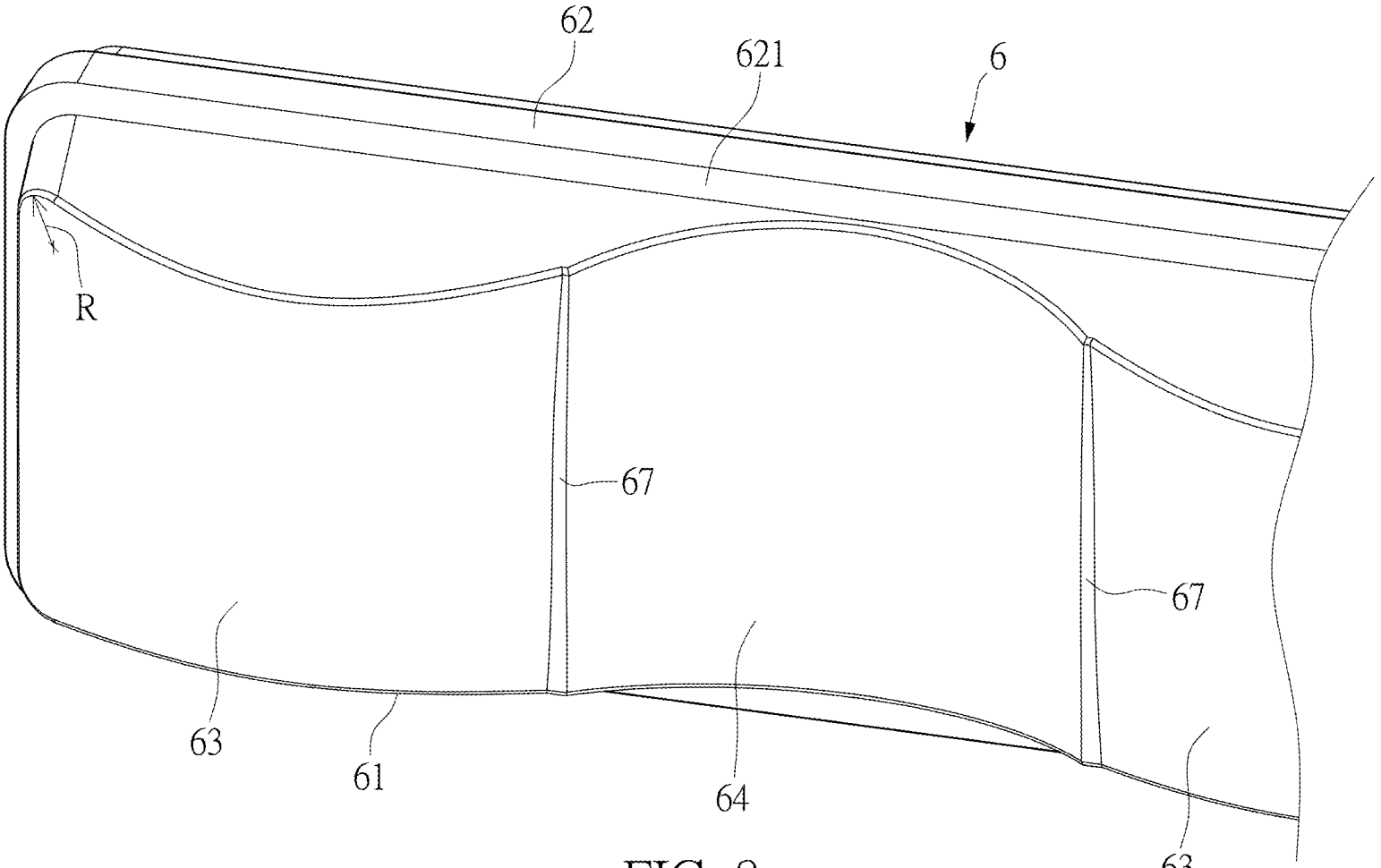
FIG. 8 is a partially schematic perspective view of the lens unit of the present disclosure.

The lens unit 6 is located at a front end of the supporting frame 4, and the lens unit 6 can be fixed to the front end of the supporting frame 4 in a manner such as snap-engagement. In this embodiment, the lens unit 6 has a lens body 61 (as shown in FIG. 7 and FIG. 8), a flange 62 is formed on one edge of the lens body 61, a rear end of the flange 62 has a planar region 621, and the planar region 621 can undergo a matte treatment to have a matte surface. The front end of the supporting frame 4 has a stopping portion 41, and a top side and a bottom side of the supporting frame 4 each has at least one engaging member 42 disposed thereon. The flange 62 of the lens unit 6 can be held between the stopping portion 41 and the engaging member 42 (as shown in FIG. 5), such that the lens unit 6 can be engaged and fixed to the front end of the supporting frame 4.

The lens body 61 has at least one convex surface 63 and at least one concave surface 64 formed at a rear end of the lens body 61. In this embodiment, the lens body has multiple convex surfaces 63 and multiple concave surfaces 64. The at least one convex surface 63 and the at least one concave surface 64 are arced surfaces, and the lengthwise direction A is parallel to directions toward which the convex surface 63 and the concave surface 64 are curved. The convex surfaces 63 and the concave surfaces 64 are alternately arranged, that is, one convex surface 63 and one concave surface 64 are sequentially arranged, so that the rear end of the lens body 61 is shaped in a wave. The convex surfaces 63 and the concave surfaces 64 can be arranged in the lengthwise direction A. The convex surfaces 63 and the concave surfaces 64 respectively correspond in position to the reflection surfaces 31.

An arced convex surface 65 can be formed at a front end of the lens body 61, and the lengthwise direction A is perpendicular to a direction towards which the arced convex surface 65 is curved. The light emitted by the LED units 22 can be reflected by the reflection surfaces 31, and be emitted outward through the light-blocking plate 5, and the convex surfaces 63 and the concave surfaces 64. Each one of the convex surfaces 63 and each one of the concave surfaces 64 respectively has effects of light dispersion and light convergence.

The lens unit 6 can have a plurality of rounded corners 66 that can be formed at locations such as four corners of the lens body 61 (as shown in FIG. 7 and FIG. 8). A diameter of each of the rounded corners 66 is R. When R is equal to 0.3 mm, a light shape tends to be more aesthetically pleasing, and when R is greater than 0.5 mm, more stray light is exhibited. Preferably, R is less than or equal to 0.5 mm, and when a size of the rounded corners 66 is excessively large, the stray light will be projected on dark regions.

At least one interruption surface 67 can be formed on the rear end of the lens body 61. In this embodiment, multiple interruption surfaces are formed on the rear end of the lens body 61. The interruption surfaces 67 are respectively formed between two adjacent ones of the convex surfaces 63 and the concave surfaces 64. The interruption surfaces 67 respectively correspond in position to the protruding portions 54 (as shown in FIG. 6), and each of the interruption surfaces 67 can connect the two adjacent ones of the convex surfaces 63 and the concave surfaces 64, so that a height difference is formed between the two adjacent ones of the convex surfaces 63 and the concave surfaces 64. Preferably, a width of each of the interruption surfaces 67 increases from top to bottom of the interruption surface 67 (as shown in FIG. 8), such that a width of each of the interruption surfaces 67 is wider on top and narrower at the bottom. The interruption surfaces 67 can widen the light shape, so that the use rate of the light is increased. The interruption surfaces 67 respectively correspond in position to the protruding portions 54, and the protruding portions 54 can block a light overspill from occurring in the lens unit 6. The interruption surfaces and the protruding portions 54 respectively have a gap 68 therebetween for preventing friction; preferably, the gap 68 is from 1 mm to 3 mm.

Figure 3:
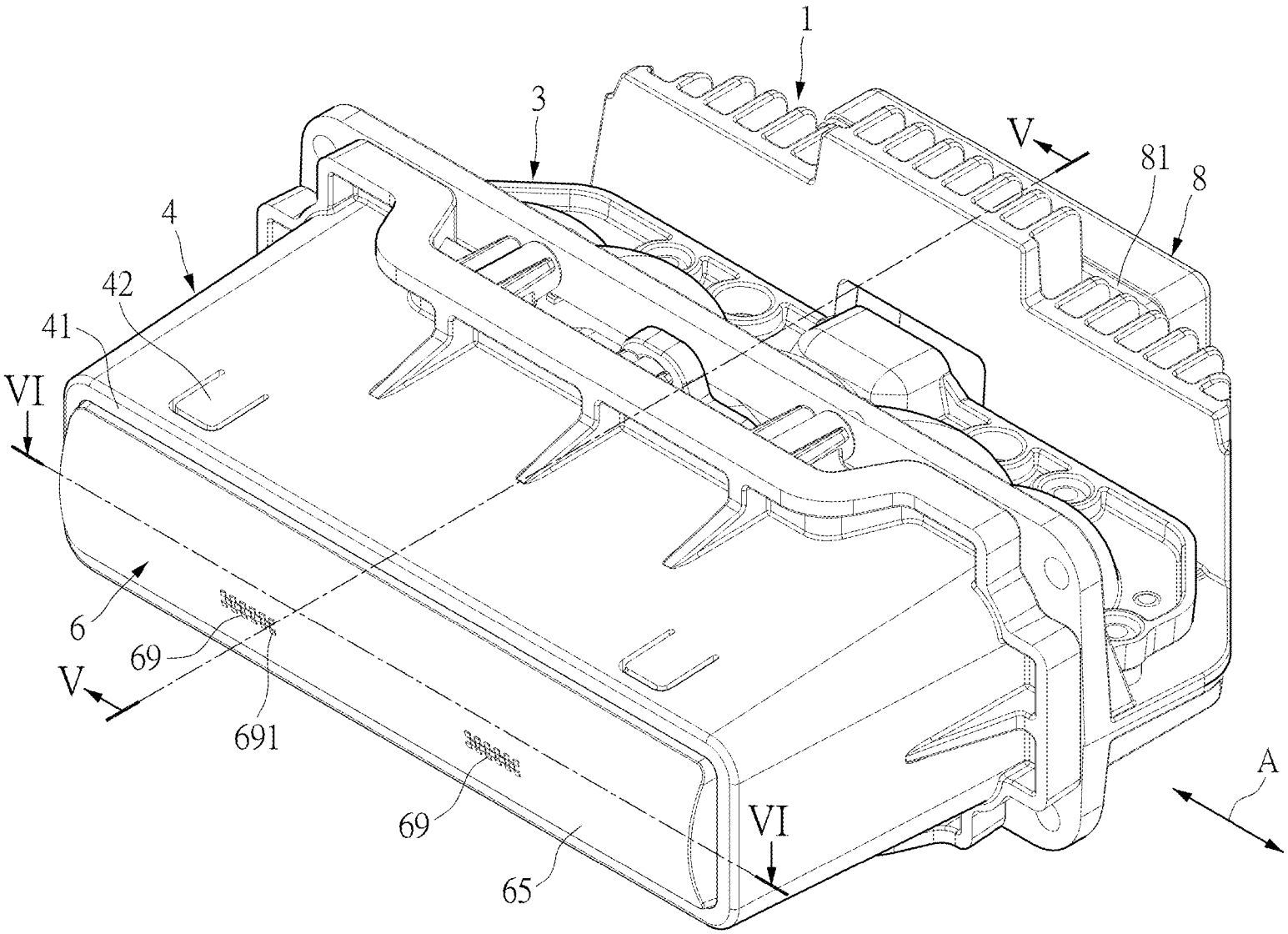
FIG. 3 is a schematic perspective view of the vehicle lamp of the present disclosure.
Figure 4:
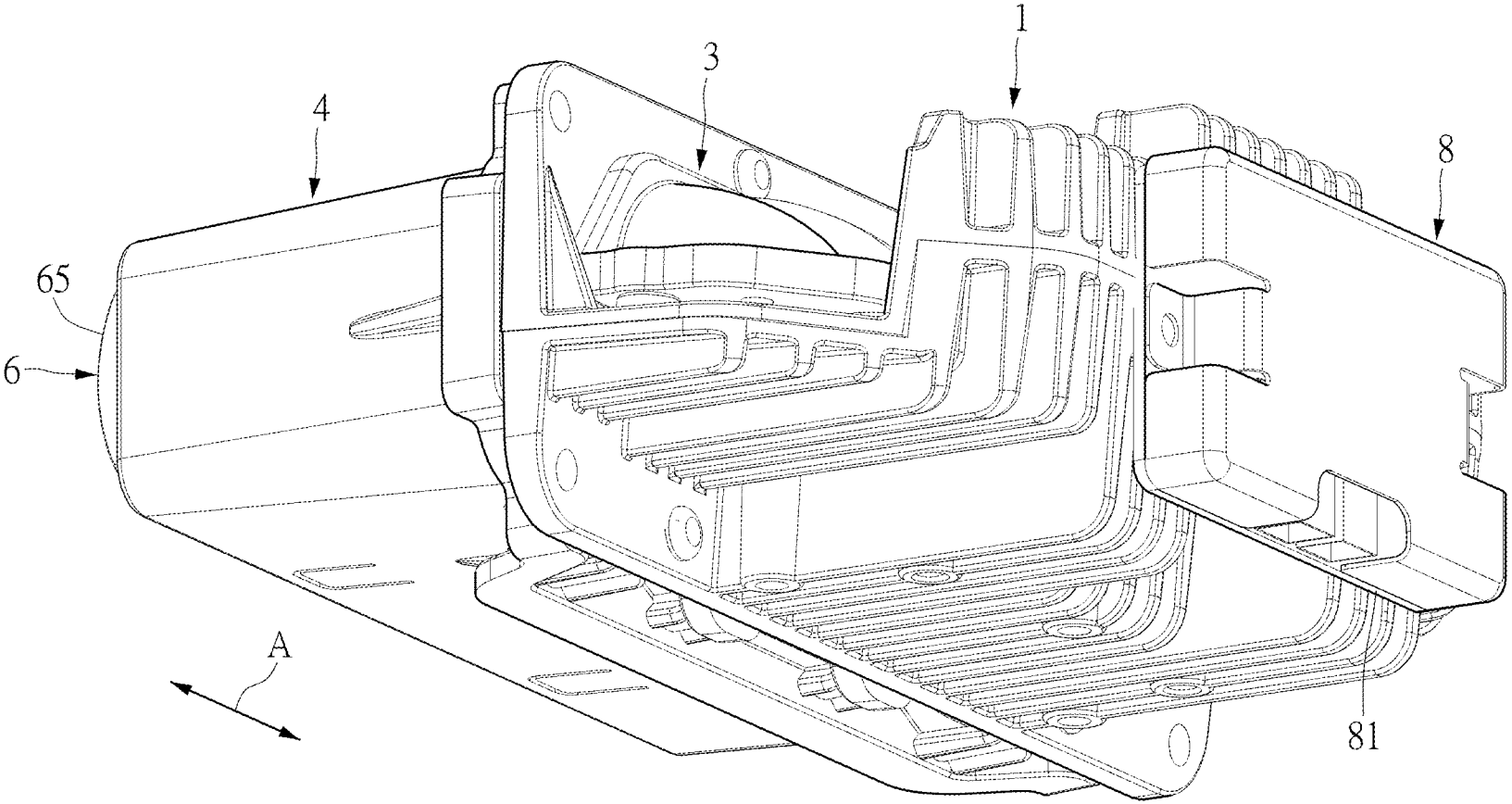
FIG. 4 is another schematic perspective view of the vehicle lamp of the present disclosure.

Two microstructures 69 are disposed at a front end of the lens body 61 (as shown in FIG. 1 and FIG. 3), and the two microstructures 69 are formed at a middle of the front end of the lens body 61 and are laterally spaced apart from the middle of the front end. Each of the two microstructures 69 includes a plurality of block bodies 691 that protrude outward, the block bodies 691 are arranged into multiple horizontal rows, and any two adjacent rows of the block bodies 691 are staggeredly arranged. The two microstructures 69 can provide light refraction effects so that the vehicle lamp structure conforms to light shape regulations.

The light-shielding plate 7 is disposed on the heat dissipating plate 1, the light-shielding plate 7 is located in front of the LED light source 2, and a reflection layer 71 is disposed on a top surface of the light-shielding plate 7. The reflection layer 71 can be an electroplating layer. When the LED units 22 emit light, the light can be reflected by the reflection surfaces 31, and emitted outward through the light-blocking plate 5 and the lens unit 6; then, some of the lights that are diffused or scattered can be reflected by using the reflection layer 71, so as to improve the use rate of the light.

Figure 10:
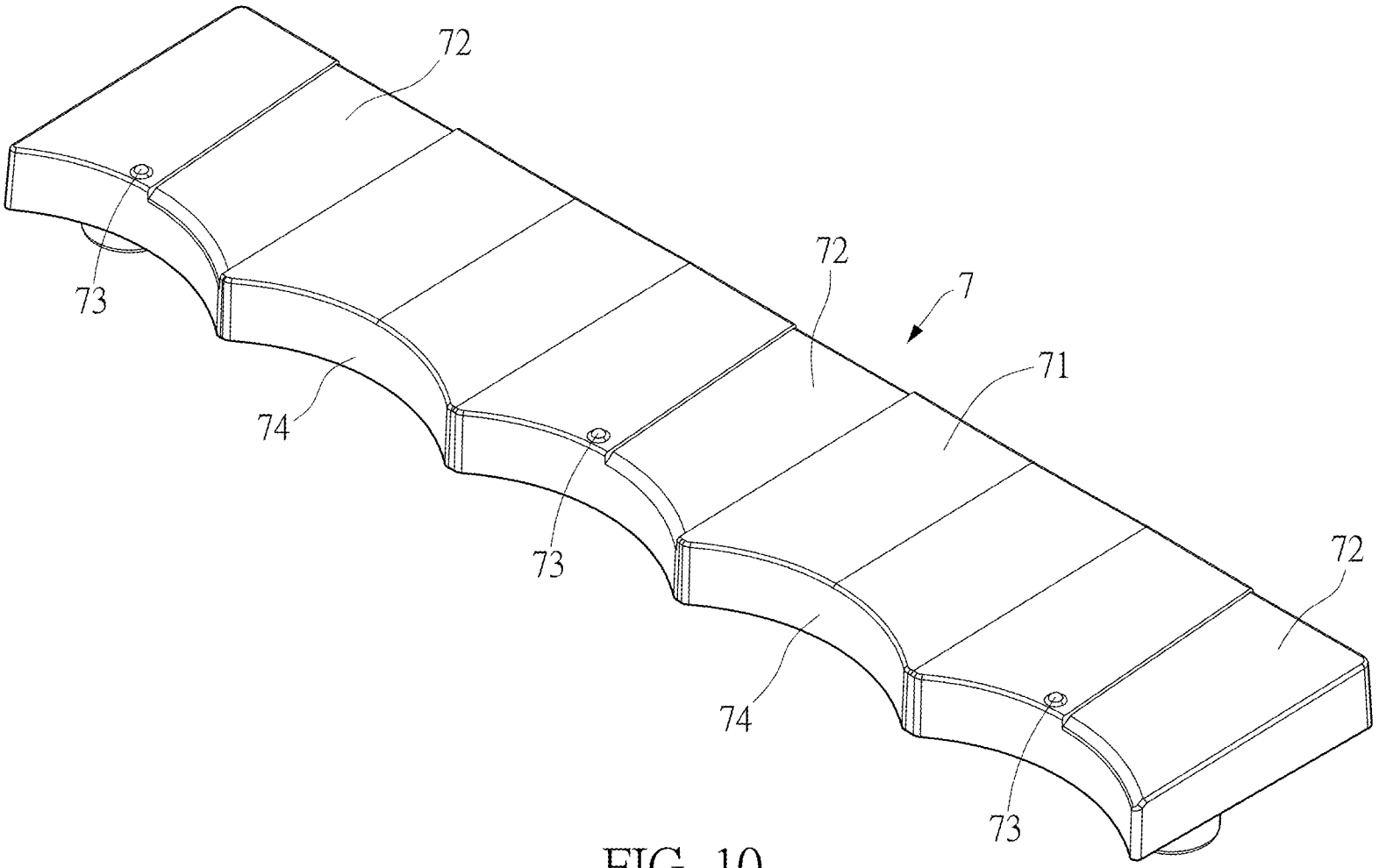
FIG. 10 is a schematic perspective view of the light-shielding plate of the present disclosure.
Figure 11:
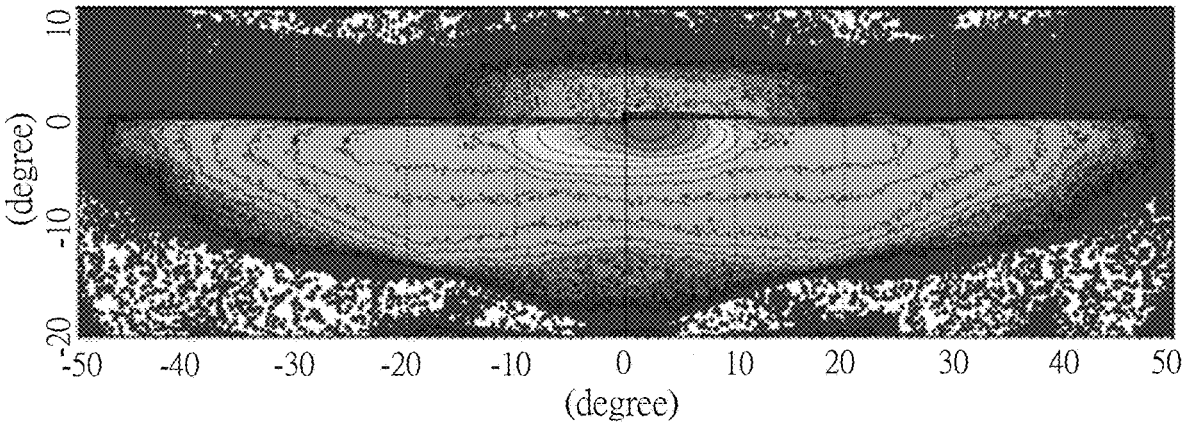
FIG. 11 is an illuminance map of the vehicle lamp of the present disclosure.

At least one height difference region 72 and at least one protruding bump 73 are formed on the top surface of the light-shielding plate 7 (as shown in FIG. 10), and in this embodiment, multiple height difference regions 72 and multiple protruding bumps 73 are formed on the top surface of the light-shielding plate 7. The height difference regions 72 are spaced apart from each other, and the height difference regions 72 are recessed from the top surface of the light-shielding plate 7 and extend to a front end and a rear end of the light-shielding plate 7, and the height difference regions 72 correspond in position to one side of the concave surface 63 (as shown in FIG. 9), so as to provide the function of a cutoff line for the light shape. The height difference regions 72 can be disposed to provide a predetermined light shape, so that the illuminated regions and the dark regions form the predetermined light shape. Furthermore, the vehicle lamp structure can conform to the light shape regulations.

The protruding bumps 73 are spaced apart from each other, and the protruding bumps 73 protrude from the top surface of the light-shielding plate 7. The protruding bumps 73 are adjacent to the front end of the light-shielding plate 7, and the protruding bumps 73 respectively correspond in position to the middle of the concave surfaces 63. The protruding bumps 73 can be disposed to provide a predetermined light shape, so that the predetermined dark regions can be present in the illuminated regions to form the predetermined light shape. Furthermore, the vehicle lamp structure can conform to the light shape regulations.

A plurality of arced concave surfaces 74 can be formed on the front end of the light-shielding plate 7, and the arced concave surfaces 74 respectively correspond in position to the convex surfaces 63 and the concave surfaces 64. The arced concave surfaces 74 can be oblique surfaces (as shown in FIG. 5), that is, the arced concave surfaces 74 can be inclined rearward from bottom to top of the arced concave surfaces 74. The arced concave surfaces 74 can be coarsely grinded surfaces or non-electroplated surfaces, so as to avoid the generation of stray light from high brightness surfaces of the arced concave surfaces 74.

The light emitted from the LED units 22 of the LED light source can be reflected by the reflection surfaces 31 of the reflector 3, and emitted outward through the light-blocking plate 5 and the lens unit 6 so that the vehicle lamp structure emits a low-beam light. In other embodiments, the light-shielding plate 7 can be omitted, and the reflector 3 and the lens unit 6 are appropriately arranged so that the vehicle lamp structure emits a high-beam light.

Beneficial Effects of the Embodiment

In conclusion, in the vehicle lamp structure provided by the present disclosure, the vehicle lamp structure includes a heat dissipating device, an LED light source, a reflector, a supporting frame, a light-blocking plate, and a lens unit. The LED light source, the reflector, and the supporting frame are disposed on the heat dissipating device. The LED light source includes a substrate and a plurality of LED units that are arranged along a lengthwise direction. The reflector has a plurality of reflection surfaces that are respectively located above the LED units such that light emitted by the LED units is reflected by the plurality of reflection surfaces. The light-blocking plate is disposed in the supporting frame and has a frame body and at least one baffle, and the baffle is disposed in the frame body, such that through holes are formed in the frame body so that the light reflected by the plurality of reflection surfaces can pass through the through holes, respectively. In this way, light diffraction or interference can be avoided. The lens unit is located at a front end of the supporting frame. The lens unit has a lens body that has at least one convex surface and at least one concave surface formed at a rear end of the lens body, the at least one convex surface and the at least one concave surface are arced surfaces, and the at least one convex surface and the at least one concave surface respectively correspond in position to the reflection surfaces. The convex surface and the concave surface respectively have effects of light dispersion and light convergence so as to control a refraction of the light, such that the light can be projected as anticipated. Therefore, an expected lighting effect can be provided, and the safety and use rate of light usage can be improved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A vehicle lamp structure, comprising:

a heat dissipating device;

an LED light source disposed on the heat dissipating device, wherein the LED light source includes a substrate and a plurality of LED units that are disposed on the substrate and arranged along a lengthwise direction;

a reflector disposed on the heat dissipating device, wherein the reflector has a plurality of reflection surfaces that are respectively located above the LED units such that light emitted by the LED units is reflected by the plurality of reflection surfaces;

a supporting frame disposed on the heat dissipating device and having a hollow body;

a light-blocking plate disposed in the supporting frame, wherein the light-blocking plate has a frame body and at least one baffle, and the baffle is disposed in the frame body so that a plurality of through holes are formed in the frame body; wherein the plurality of through holes are spaced apart from each other such that the light reflected by the plurality of reflection surfaces is able to pass through the plurality of through holes, respectively; and a lens unit located at a front end of the supporting frame, wherein the lens unit has a lens body that has at least one convex surface and at least one concave surface formed at a rear end of the lens body, the at least one convex surface and the at least one concave surface are arced surfaces, and the at least one convex surface and the at least one concave surface respectively correspond in position to the reflection surfaces;

wherein a front end of the baffle has a protruding portion extended therefrom; wherein the protruding portion protrudes from a front end of the frame body, and one side of the protruding portion that is adjacent to the at least one concave surface has an oblique surface;

wherein the light emitted by the LED units is able to be reflected by the plurality of reflection surfaces before being emitted outward through the light-blocking plate and the lens unit.

2. The vehicle lamp structure according to claim 1, wherein a driving device is disposed at a rear end or a bottom portion of the heat dissipating device, and the driving device is electrically connected to the LED light source; wherein the driving device is capable of driving the LED light source such that the LED light source emits the light; wherein the driving device has an aluminum plate that is in contact with the heat dissipating device.

3. The vehicle lamp structure according to claim 1, wherein the LED units are in a linear arrangement or substantially in a linear arrangement.

4. The vehicle lamp structure according to claim 1, wherein at least one interruption surface is formed on the rear end of the lens body, and the at least one interruption surface is formed between the convex surface and the concave surface that are adjacent to each other; wherein the at least one interruption surface corresponds in position to the protruding portion, and a width of the at least one interruption surface increases from top to bottom of the at least one interruption surface.

5. The vehicle lamp structure according to claim 4, wherein the at least one interruption surface and the protruding portion have a gap therebetween that is from 1 mm to 3 mm.

6. The vehicle lamp structure according to claim 1, wherein a flange is formed on one edge of the lens body, and a rear end of the flange has a planar region that has a matte surface.

7. The vehicle lamp structure according to claim 1, wherein the lengthwise direction is parallel to directions toward which the convex surface and the concave surface are curved, an arced convex surface is formed at a front end of the lens body, and the lengthwise direction is perpendicular to a direction towards which the arced convex surface is curved.

8. The vehicle lamp structure according to claim 1, wherein the rear end of the lens body has multiple ones of the convex surface and the concave surface formed thereon, the convex surfaces and the concave surfaces are alternately arranged, and the convex surfaces and the concave surfaces are arranged in the lengthwise direction.

9. The vehicle lamp structure according to claim 1, wherein two microstructures are disposed at a front end of the lens body, and the two microstructures are formed at a middle of the front end of the lens body and are laterally spaced apart from the middle of the front end; wherein each of the two microstructures includes a plurality of block bodies that protrude outward, the block bodies are arranged into multiple horizontal rows, and any two adjacent rows of the block bodies are staggeredly arranged.

10. The vehicle lamp structure according to claim 1, further comprising a light-shielding plate disposed on the heat dissipating plate, wherein the light-shielding plate is located in front of the LED light source, and a reflection layer is disposed on a top surface of the light-shielding plate; wherein at least one height difference region is formed on the top surface of the light-shielding plate, the at least one height difference region is recessed from the top surface of the light-shielding plate and extends to a front end and a rear end of the light-shielding plate, and the at least one height difference region corresponds in position to one side of the concave surface.

11. The vehicle lamp structure according to claim 10, wherein the top surface of the light-shielding plate has at least one protruding bump formed thereon, and the protruding bump protrudes from the top surface of the light-shielding plate; wherein the protruding bump is adjacent to the front end of the light-shielding plate, and the protruding bump corresponds in position to a middle of the concave surface.

12. The vehicle lamp structure according to claim 10, wherein a plurality of arced concave surfaces are formed on the front end of the light-shielding plate, and the plurality of arced concave surfaces respectively correspond in position to the convex surface and the concave surface; wherein the plurality of arced concave surfaces are oblique surfaces, and are inclined rearward from bottom to top of the plurality of arced concave surfaces.

13. The vehicle lamp structure according to claim 1, wherein the lens unit has a plurality of rounded corners that are formed at four corners of the lens body, a diameter of each of the rounded corners is R, and R is less than or equal to 0.5 mm.

14. A vehicle lamp structure, comprising:

a heat dissipating device;

an LED light source disposed on the heat dissipating device, wherein the LED light source includes a substrate and a plurality of LED units that are disposed on the substrate and arranged along a lengthwise direction;

a reflector disposed on the heat dissipating device, wherein the reflector has a plurality of reflection surfaces that are respectively located above the LED units such that light emitted by the LED units is reflected by the plurality of reflection surfaces;

a supporting frame disposed on the heat dissipating device and having a hollow body;

a light-blocking plate disposed in the supporting frame, wherein the light-blocking plate has a frame body and at least one baffle, and the baffle is disposed in the frame body so that a plurality of through holes are formed in the frame body; wherein the plurality of through holes are spaced apart from each other such that the light reflected by the plurality of reflection surfaces is able to pass through the plurality of through holes, respectively; and a lens unit located at a front end of the supporting frame, wherein the lens unit has a lens body that has at least one convex surface and at least one concave surface formed at a rear end of the lens body, the at least one convex surface and the at least one concave surface are arced surfaces, and the at least one convex surface and the at least one concave surface respectively correspond in position to the reflection surfaces;

wherein the light emitted by the LED units is able to be reflected by the plurality of reflection surfaces before being emitted outward through the light-blocking plate and the lens unit wherein the rear end of the lens body has multiple ones of the convex surface and the concave surface formed thereon, the convex surfaces and the concave surfaces are alternately arranged, and the convex surfaces and the concave surfaces are arranged in the lengthwise direction.

15. A vehicle lamp structure, comprising:

a heat dissipating device;

an LED light source disposed on the heat dissipating device, wherein the LED light source includes a substrate and a plurality of LED units that are disposed on the substrate and arranged along a lengthwise direction;

a reflector disposed on the heat dissipating device, wherein the reflector has a plurality of reflection surfaces that are respectively located above the LED units such that light emitted by the LED units is reflected by the plurality of reflection surfaces;

a supporting frame disposed on the heat dissipating device and having a hollow body;

a light-blocking plate disposed in the supporting frame, wherein the light-blocking plate has a frame body and at least one baffle, and the baffle is disposed in the frame body so that a plurality of through holes are formed in the frame body; wherein the plurality of through holes are spaced apart from each other such that the light reflected by the plurality of reflection surfaces is able to pass through the plurality of through holes, respectively; and a lens unit located at a front end of the supporting frame, wherein the lens unit has a lens body that has at least one convex surface and at least one concave surface formed at a rear end of the lens body, the at least one convex surface and the at least one concave surface are arced surfaces, and the at least one convex surface and the at least one concave surface respectively correspond in position to the reflection surfaces;

wherein the light emitted by the LED units is able to be reflected by the plurality of reflection surfaces before being emitted outward through the light-blocking plate and the lens unit;

wherein two microstructures are disposed at a front end of the lens body, and the two microstructures are formed at a middle of the front end of the lens body and are laterally spaced apart from the middle of the front end; wherein each of the two microstructures includes a plurality of block bodies that protrude outward, the block bodies are arranged into multiple horizontal rows, and any two adjacent rows of the block bodies are staggeredly arranged.

* * * * *